US006602118B1

(12) United States Patent
Johnson

(10) Patent No.: US 6,602,118 B1
(45) Date of Patent: Aug. 5, 2003

(54) ORBITAL FINISHING SANDER

(76) Inventor: Chad Johnson, 602 Cedar St., Ashland, NE (US) 68503

( * ) Notice: Subject to any disclaimer, the term of this patent is extended or adjusted under 35 U.S.C. 154(b) by 0 days.

(21) Appl. No.: 09/712,441

(22) Filed: Nov. 14, 2000

Related U.S. Application Data

(60) Provisional application No. 60/165,515, filed on Nov. 15, 1999.

(51) Int. Cl.[7] ..... G24B 7/28; B24B 7/06
(52) U.S. Cl. ..... 451/65; 451/270; 451/57
(58) Field of Search ..... 451/11, 5, 270, 451/271, 260, 65, 57, 59

(56) References Cited

U.S. PATENT DOCUMENTS 4,733,500 A * 3/1988 David ..... 451/65
4,864,775 A * 9/1989 David ..... 451/303
6,244,933 B1 * 6/2001 Morkvenas ..... 451/270

FOREIGN PATENT DOCUMENTS

NL 8802627 * 5/1990 ..... 451/11

* cited by examiner

*Primary Examiner*—Robert A. Rose
(74) *Attorney, Agent, or Firm*—Adam H. Jacobs

(57) ABSTRACT

An orbital finishing sander for finishing coarsely sanded wood pieces includes a support frame and a conveyor belt movably mounted on the frame and extending generally horizontally thereon. An orbital sander support such as a plate is mounted on the frame and extends over and above the conveyor belt for supporting at least one orbital sander vertically movably mounted on the orbital sander support, the orbital sander being movable between a lowered engagement position and a raised non-engagement position. At least one orbital sander movement device such as a pneumatic ram would be operatively connected to each one orbital sander for moving the associated orbital sander between the lowered engagement position and the raised non-engagement position. The present invention also includes at least one switch device operatively connected to the orbital sander movement devices to engage the orbital sander movement devices to move the orbital sanders between the lowered engagement position and the raised non-engagement position in response to the switch devices detecting a wood product to be sanded.

2 Claims, 4 Drawing Sheets

ORBITAL FINISHING SANDER

This application claims the benefit of provisional application No. 60/165,515 filed Nov. 15, 1999.

BACKGROUND OF THE INVENTION

1. Technical Field

The present invention relates to sanding units for cabinet doors and, more particularly, to a combination drum and orbital sander unit for cabinet doors which includes a first drum sanding unit for coarsely sanding the cabinet door, a second set of orbital sanding units which engage the cabinet door and provide finish sanding and a belt unit for moving the cabinet door being sanded under the sanding unit.

2. Description of the Prior Art

In the prior art, as shown in FIG. 5, when a drum sander sands a wood door surface, the portions of the door having the grain aligned with the rotation of the drums (specifically the "styles") are coarsely sanded resulting in some scratching but the scratching is aligned with the grain and can easily be sanded out. However, the scratching formed on the "rails" is cross-grain and is very difficult to sand out, necessitating a large investment of time and energy by the individual doing the finish sanding. An example of such cross-grain scratching is shown in FIG. 6. At present, there is no example found in the prior art of a drum sander which will not create this cross-grain scratching.

The maker of the door is thus forced to manually sand the rails of the door to remove the cross-grain scratching, which takes considerable time and effort. Moreover, the speed with which doors can be manufactured is greatly reduced, and in smaller shops, this increases the cost of manufacture and decreases profit margins. There is therefore a need for a finishing sander device which will remove the cross-grain scratching from the door during the manufacturing process without requiring a large investment of manual labor.

Also, there is a need for a finishing sanding device which utilizes orbital sanders as opposed to the traditional drum-type sander, as these sanders are generally more suited to finishing work. Of course, use of orbital sanders will only be acceptable if the entire surface of the door can be finished during the manufacturing process, and this can be done best with a plurality of overlapping orbital sanders which finish the door in one pass. At present, there is no example found in the prior art which incorporates such an arrangement of sanders.

Therefore, an object of the present invention is to provide an improved orbital finishing sander.

Another object of the present invention is to provide an orbital finishing sander which includes a frame on which is mounted a conveyor belt, the conveyor belt operative to move a door to be sanded under the sanding devices which are mounted thereabove.

Another object of the present invention is to provide an orbital finishing sander having a plurality of vertically movable orbital sanders mounted on a plate above the conveyor belt, the sanders being moved downwards into sanding position upon detecting a door passing thereunder.

Another object of the present invention is to provide an orbital finishing sander which will quickly and easily remove cross-grain scratches of the kind formed by drum sanding units.

Another object of the present invention is to provide an orbital finishing sander which incorporates the plurality of orbital sanders mounted in overlapping relation to sand all of the door surface during the sanding process.

Another object of the present invention is to provide an orbital finishing sander which is a stand-alone unit and does not have to be used in connection with a drum sander.

Finally, an object of the present invention is to provide a orbital finishing sander which is relatively simple to manufacture and which is safe and durable in use.

SUMMARY OF THE INVENTION

The present invention provides an orbital finishing sander for finishing coarsely sanded wood pieces which includes a support frame and a conveyor belt movably mounted on the frame and extending generally horizontally thereon. An orbital sander support such as a plate is mounted on the frame and extends over and above the conveyor belt for supporting at least one orbital sander vertically movably mounted on the orbital sander support, the orbital sander being movable between a lowered engagement position and a raised non-engagement position. At least one orbital sander movement device such as a pneumatic ram would be operatively connected to each one orbital sander for moving the associated orbital sander between the lowered engagement position and the raised non-engagement position. The present invention also includes at least one switch device operatively connected to the orbital sander movement devices to engage the orbital sander movement devices to move the orbital sanders between the lowered engagement position and the raised non-engagement position in response to the switch devices detecting a wood product to be sanded. Finally, the switch devices and the orbital sander movement devices cooperate to move the orbital sanders downward into the lowered engagement position with a coarsely sanded wood product when the switch devices detect the wood product being positioned beneath the orbital sanders and moving the orbital sanders upward into the raised non-engagement position when the switch devices detect the wood product not being positioned beneath the orbital sanders.

The orbital finishing sander as thus described clearly offers several advantages over those devices found in the prior art. The relatively simple design of the orbital finishing sander permits the use of the invention by woodworkers of all varieties, from large companies to individual users. Also, because the present invention is designed to be used as a finishing device mounted on the sanding unit which utilizes a drum sander or the like for coarse sanding, the processing of the wood products through the sanding devices is not impeded and the speed of production is markedly increased. Furthermore, as the present invention is generally automated, it frees up the manufacturer to perform other tasks during the sanding process, which is invaluable for smaller. businesses. The present invention thus provides a substantial improvement over those devices found in the prior art.

DESCRIPTION OF THE PREFERRED EMBODIMENT

Figure 1:
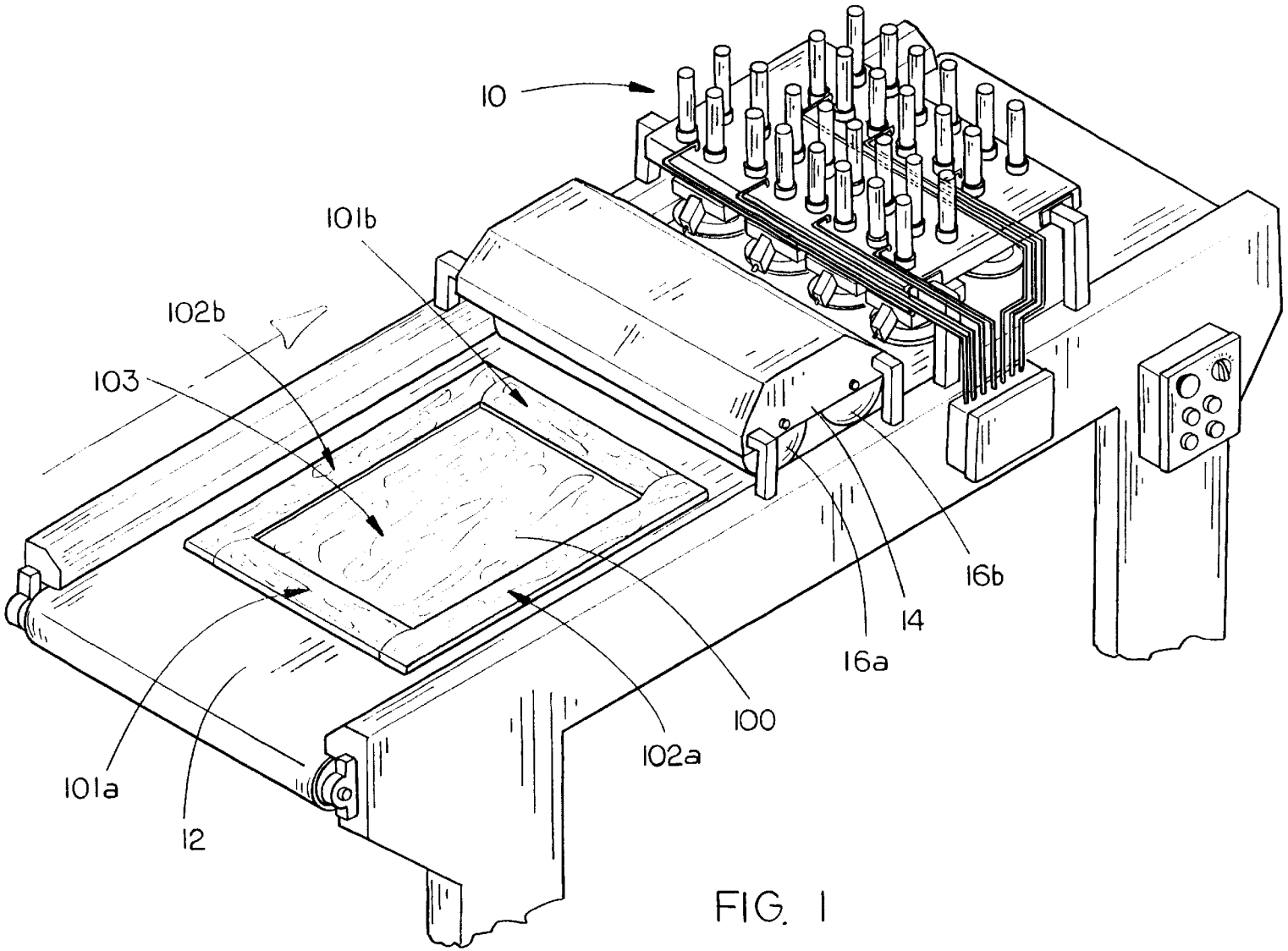
FIG. 1 is a perspective view of the orbital finishing sander of the present invention.
Figure 2:
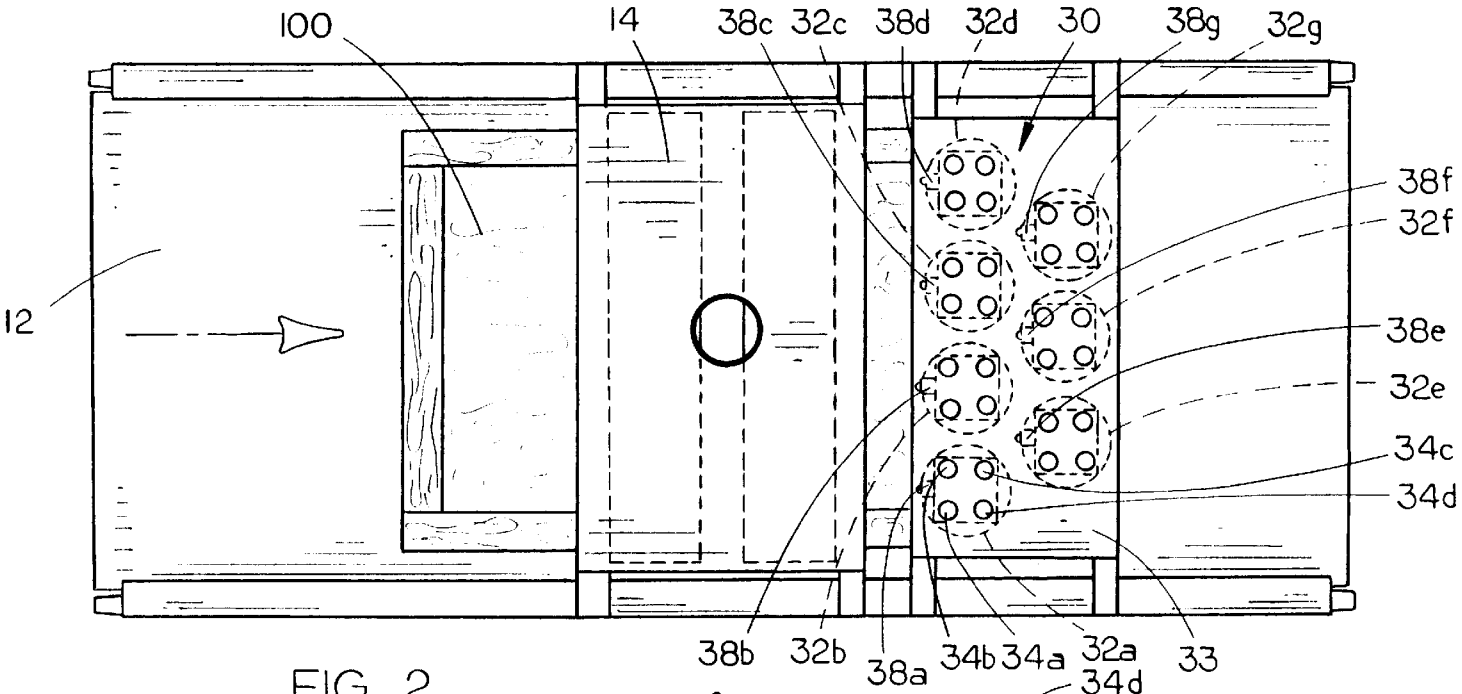
FIG. 2 is a top plan view of the present invention showing the features thereof.
Figure 3:
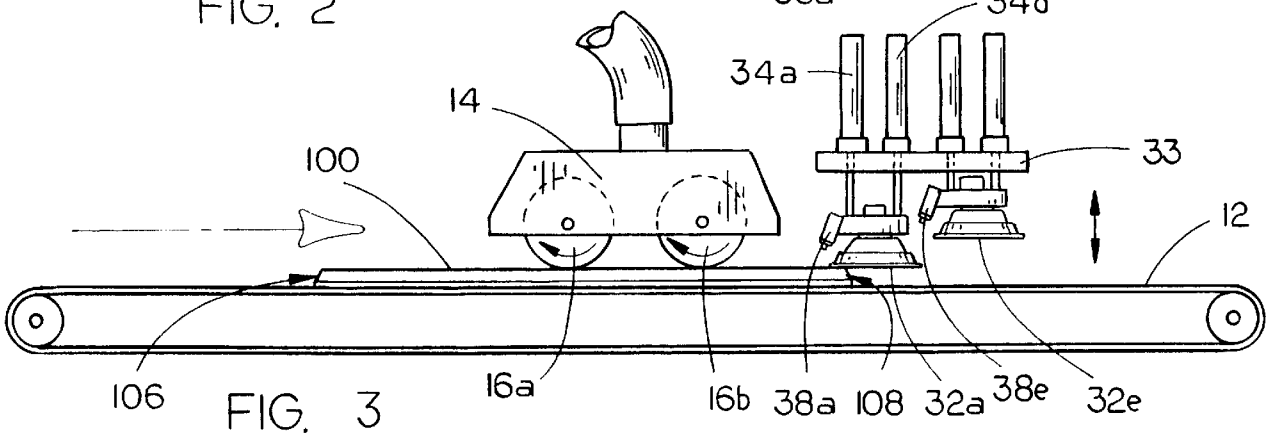
FIG. 3 is a side detail elevational view of the present invention showing the features thereof.
Figure 4:
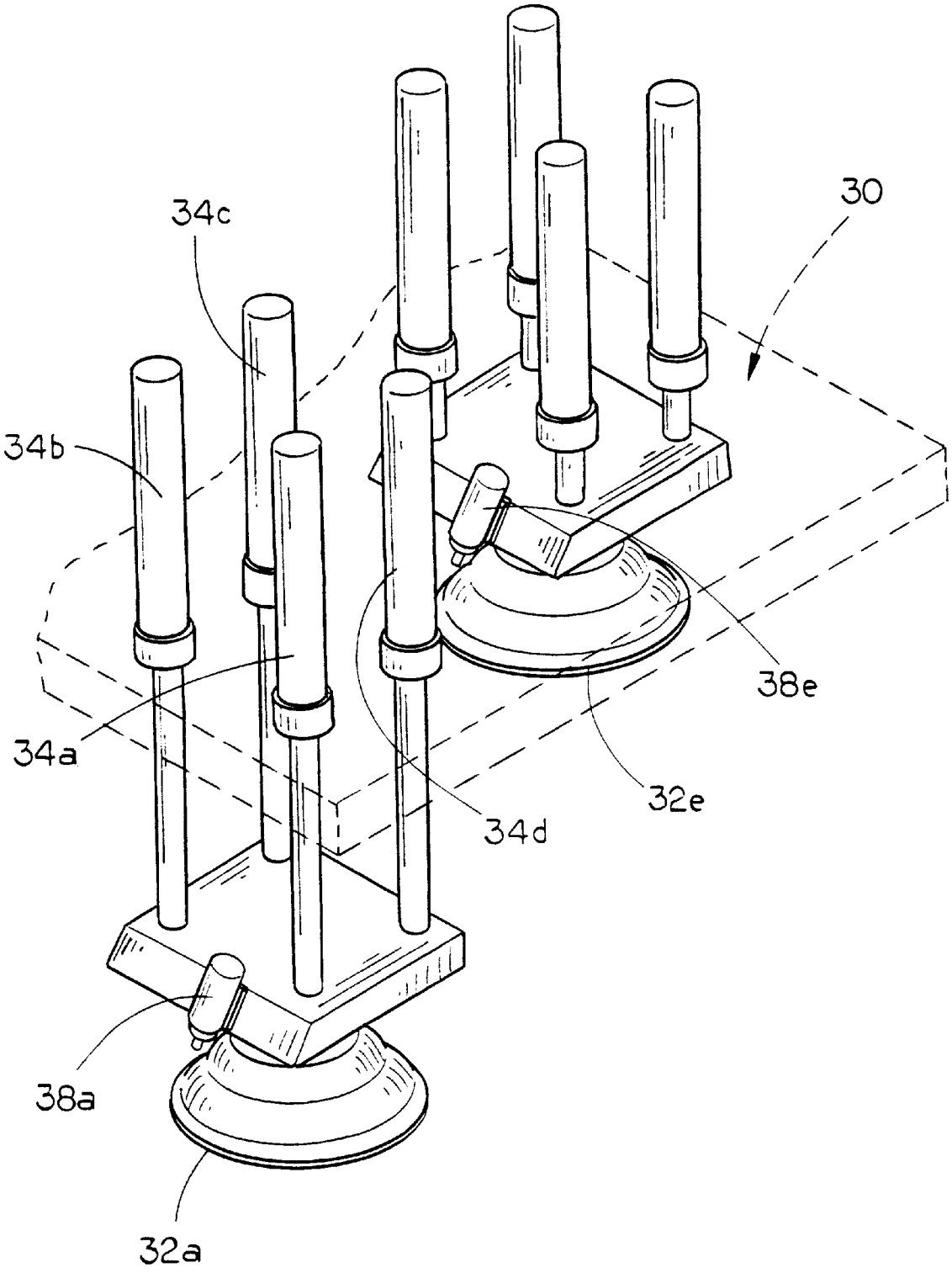
FIG. 4 is a detail perspective view of one of the orbital sanders of the present invention.

The orbital finishing sander 10 of the present invention is shown best in FIGS. 1–4 as including a generally horizontal feed conveyor belt 12 having a width of approximately 36 inches and a length of approximately 6 feet, the feed conveyor belt 12 being driven by an electric motor or the like in a clockwise direction when viewed as shown in FIG. 2. A door 100 which is to be sanded would be placed on feed conveyor belt 12 to be sent through the orbital finishing sander 10 of the present invention. Initially, a drum sander 14 would coarsely sand the door 100 to sand down the joint edges of the door 100, the drum sander 14 preferably including one or more sanding cylinders 16*a* and 16*b* which are aligned generally perpendicular to the direction of travel of door 100 and spaced from feed conveyor belt 12 such that as door 100 passes underneath sanding cylinders 16*a* and 16*b,* the upper surface of door 100 is sanded to an even height to remove joint discrepancies between the door sections. In a standard door, the three sections of door 100 include upper and lower rails 101*a* and 101*b,* left and right styles 102*a* and 102*b* and the center panel 103 with the grains on the various sections extending as shown in FIG. 3.

Figure 5:
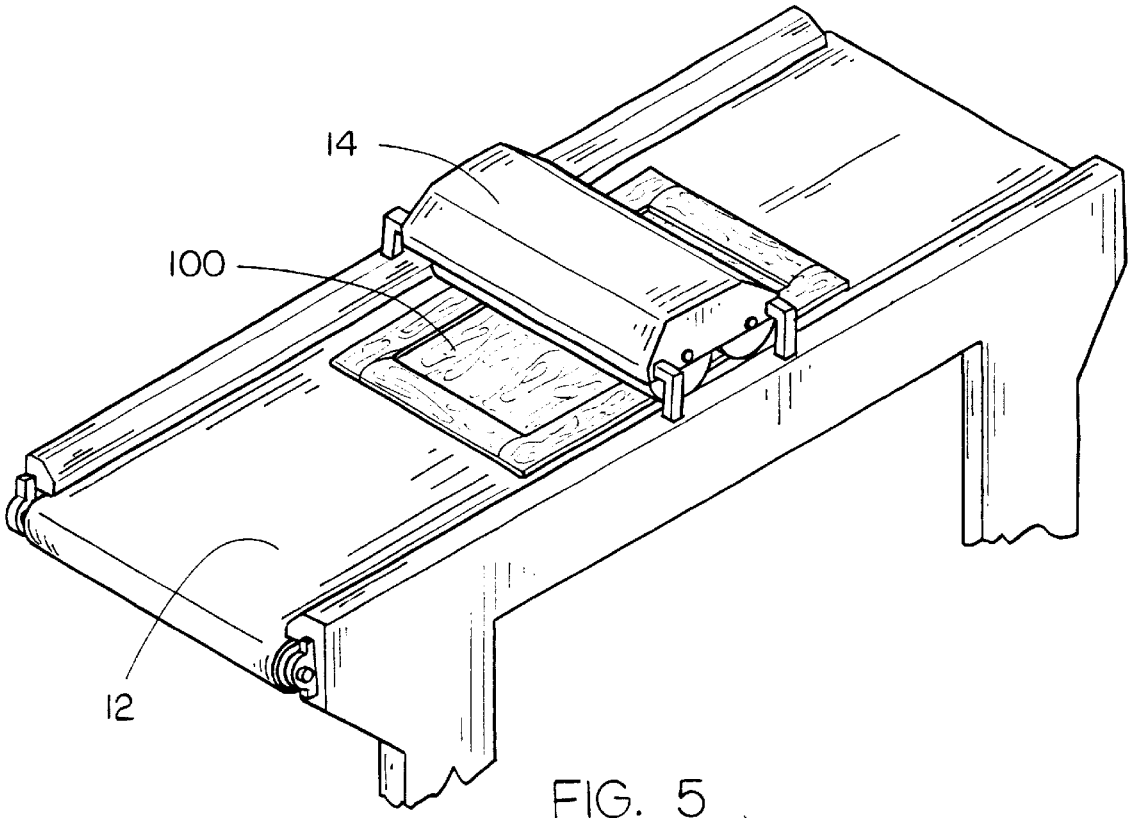
FIG. 5 (PRIOR ART)
FIGS. 5 and 6 show the sanders of the prior art and the resulting sanding work from the prior art sanders.
Figure 6:
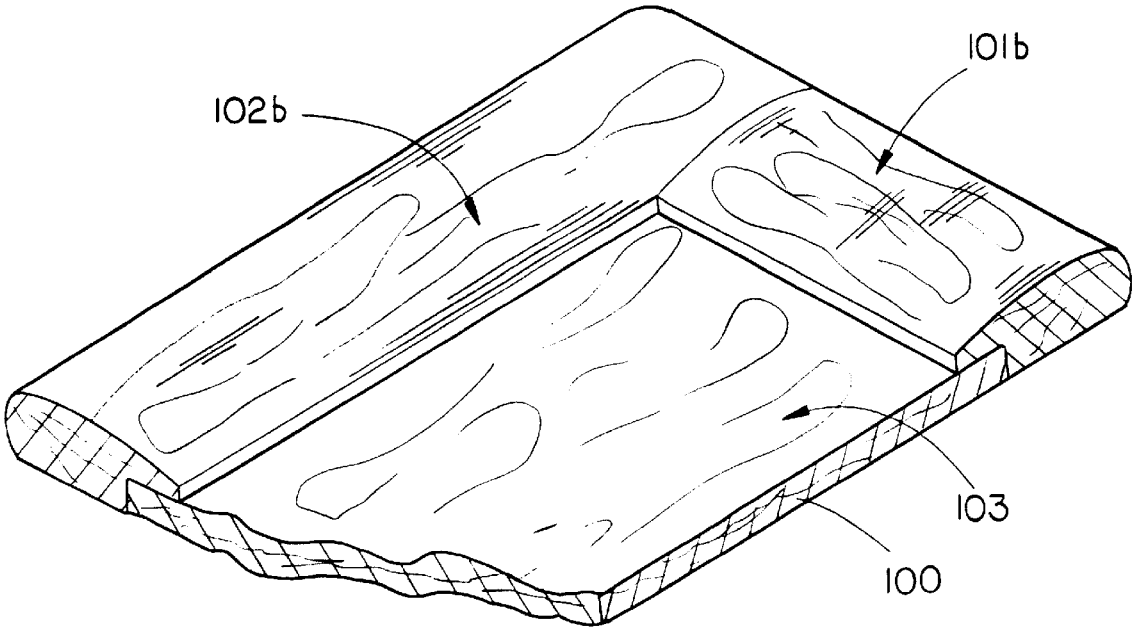
FIG. 6 (PRIOR ART)

As was discussed previously, in the prior art, shown in FIG. 5, when a drum sander sands a door surface, the portions of the door 100 having the grain aligned with the rotation of the drums (specifically the "styles") are coarsely sanded resulting in some scratching but the scratching is aligned with the grain and can easily be sanded out. However, the scratching formed on the "rails" is cross-grain and is very difficult to sand out, necessitating a large investment of time and energy by the individual doing the finish sanding. An example of such cross-grain scratching is shown in FIG. 6. At present, there is no example found in the prior art of a drum sander which will not create this cross-grain scratching.

The present invention solves this problem by providing an orbital finishing sander unit 30 which, in the preferred embodiment, would be mounted to the rear of the drum sander 14 above conveyor belt 12, the orbital finishing sander unit 30 including a plurality of orbital sanders 32*a,* 32*b,* 32*c,* 32*d,* 32*e,* 32*f* and 32*g* each mounted on a generally horizontal plate 33 with the sanding surfaces of each spaced from and adjacent to the conveyor belt 12. The orbital sanders 32*a–g* are preferably arranged in a forward row of four sanders 32*a–d* and a rearward row of three sanders 32*e–g,* with the sanders in the front row spaced approximately 1–2 inches from the adjacent sander and the rear sanders positioned between the front sanders in an overlapping configuration. In this manner, the entire door surface can be sanded during one pass through the drum and orbital cabinet sander 10 of the present invention. The orbital sanders 32*a–g* can be of any appropriate type, so long as the sanding function of the present invention is maintained.

Each of the orbital sanders 32*a–g* are mounted on a plurality of pneumatic ram cylinders, and as each of the sanders would be mounted in the same manner, the following description of the mounting of orbital sander 32*a* should be understood to apply to each of the sanders 32*b–g*. Orbital sander 32*a* is mounted beneath horizontal plate 33 and is supported by four pneumatic rams 34*a,* 34*b,* 34*c* and 34*d.* The cylinder section of each pneumatic ram 34*a–d* is mounted vertically on and above plate 33 with the piston of each pneumatic ram 34*a–d* extending downwards through plate 33 with the outer end of each piston mounted to the body of the orbital sander 32*a* as shown best in FIG. 4. When the pistons of the four pneumatic rams 34*a–d* are extended, the orbital sander 32*a* is moved downwards towards the conveyor belt 12 and the orbital sander 32*a* is moved upwards away from the conveyor belt 12 when the pistons of the four pneumatic rams 34*a–d* are retracted. It has been found that the degree of downwards force exerted by the four pneumatic rams 34*a–d* may be varied to produce appropriate sanding results, but in no event should the downward force exceed the force necessary to overcome the frictional connection between the door 100 and the conveyor belt the orbital sander 32*a* is moved downwards towards the conveyor belt 12. Furthermore, due to the arrangement of the rams 34*a–d* spaced circumferentially from one another, substantially equal pressure is applied to the sanding disk to produce uniform sanding results. It is preferred that the pneumatic rams 34*a–d* be connected to a compressed air supply which will supply compressed air to each of the rams 34*a–d* at a preset pressure so that the downwards force applied to each sander is approximately equal.

Positioned in front of each of the orbital sanders 32*a–g* is a switch 38*a–g* which senses the top 106 and the bottom 108 of the door 100 passing thereunder and "trips" in response to the door top 106 or bottom 108 being sensed. The switches 38*a–g* may be of various types such as physical contact switches, electric eye sensors or pressure sensors, so long as the function of recognizing and signaling the passage of the top 106 or bottom 108 of the door is performed. When one of the switches 38*a–g* is tripped, a programmable logic control device is engaged which detects the belt speed and starts a related delay timer which will delay the engagement of the orbital sanders 32*a–g* with the door surface until the door 100 has been moved underneath the sander 32*a–g* by the conveyor belt 12. The timer delays the engagement of the pneumatic rams 34*a–d* and then opens the compressed air valve or valves associated the pneumatic rams 34*a–d* to send compressed air to the rams to force the sanding disk of the orbital sander 32*a* downwards onto the door 100. As the door 100 passes underneath each of the sanders 32*a–g*, the door surface is sanded to remove imperfections and the cross-grain scratching caused by the drum sander 14. Finally, as the door bottom 108 passes underneath the switches 38*a–g,* each switch 38*a–g* is tripped again and engages the programmable logic control device to engage the delay timer which delays the disengagement of the orbital sanders 32*a–g* from the door 100 until the very bottom of the door 100 is correctly sanded. In the preferred embodiment, the delay timers would have a delay time of 1.5 to 3 seconds to properly control the engagement and disengagement of the orbital sanders 32*a–g* with the door 100, depending on the speed of the conveyor belt 12 as sensed by the programmable logic control device. The disengagement of the sanders 32*a–g* is performed by the retraction of the pistons into the cylinder section of each pneumatic ram 34*a–d* thus moving the orbital sanders 32*a–g* upwards out of engagement with door 100. The finished door 100 is then removed from the device 10 by conveyor belt 12.

It is also preferred that each of the orbital sanders 32*a–g* include a type of fail-safe switch operatively connected to the pneumatic rams 34*a–d.* Each fail-safe switch would be operative to raise the orbital sander 32*a–g* with which it is associated if the approach of a door 100 is sensed and the orbital sander 32*a–g* is in engagement position, i.e. lowered by the pneumatic rams 34*a–d.* In this manner, accidental engagement of the door 100 is prevented and damage to the door 100 and potential injury is avoided.

It should be noted that the present invention is primarily directed to the orbital finishing sander and not to the combination of the drum and orbital sander. In fact, although this disclosure discusses the use of a drum sander for coarsely finishing the door, any type of sanding device may be used with the present invention prior to finish sanding by the orbital finishing sander of the present invention. Therefore, the present invention is designed not only for use as the final step in an assembly line type of sanding process, but also as a stand-alone device for finishing hand-sanded or other prepared wood products.

It is to be understood that numerous modifications, substitutions and additions may be made to the orbital finishing sander described herein. For example, the exact dimensions, materials and functional characteristics of the features described above may be changed or modified yet still fall within the intended broad scope of the appended claims. Furthermore, it is clear that variations in the types of orbital sanders may be incorporated so long as the sanding function of the present invention is not impaired. Additionally, the precise arrangement of the features of the orbital finishing sander described herein may be changed or modified so long as the functionality of the invention is not impaired. It should also be noted that the present invention, although primarily described as being used in the finishing of cabinet doors or the like, can be used with many different types of wood products, the modifications for which would be understood by one skilled in the use of the present invention. Finally, modification of the size, shape and appearance of the orbital finishing sander described herein is expected and will not affect the disclosure contained herein.

There has therefore been shown and described an orbital finishing sander which accomplishes at least all of its intended purposes.

I claim:

1. In combination:

a coarse finish sanding device for preliminarily sanding a wood product; and an orbital finishing sander for finishing the coarsely sanded wood product, said sander comprising;

a support frame;

conveyor means mounted on said frame including moving belt means extending generally horizontally thereon;

sander support means mounted on said frame and extending over and above said conveyor belt;

at least one sanding device vertically movably mounted on said sander support means, said at least one sanding device between a lowered engagement position and a raised non-engagement position;

at least one sanding device movement means operatively connected to said at least one sanding device for moving said at least one sanding device between said lowered engagement position and said raised non-engagement position;

at least one switch means operatively connected to said at least one sanding device movement means to engage said at least one sanding device movement means to move said at least one sanding device between said lowered engagement position and said raised non-engagement position in response to said at least one switch means detecting a wood product to be sanded; and said at least one switch means and said at least one sanding device movement means cooperating to move said at least one sanding device downwards into said lowered engagement position with a coarsely sanded wood product when said at least one switch means detects the wood product being positioned beneath said at least one sanding device and moving said at least one sanding device upwards into said raised non-engagement position when said at least one switch means detects the wood product not being positioned beneath said at least one sanding device.

2. The combination of claim 1 wherein said coarse finish sanding device comprises a drum sander.

* * * * *